US007243912B2

(12) United States Patent
Petit et al.

(10) Patent No.: US 7,243,912 B2
(45) Date of Patent: Jul. 17, 2007

(54) AERATION DIFFUSER MEMBRANE SLITTING PATTERN

(75) Inventors: Peter Petit, Pewaukee, WI (US); Tieniu Chen, Bayside, WI (US)

(73) Assignee: Siemens Water Technologies Holding Corp., Warrendale, PA (US)

( * ) Notice: Subject to any disclaimer, the term of this patent is extended or adjusted under 35 U.S.C. 154(b) by 125 days.

(21) Appl. No.: 11/065,529

(22) Filed: Feb. 24, 2005

(65) Prior Publication Data

US 2005/0184408 A1 Aug. 25, 2005

Related U.S. Application Data

(60) Provisional application No. 60/547,370, filed on Feb. 24, 2004.

(51) Int. Cl.
*B01F 3/04* (2006.01)

(52) U.S. Cl. ..... 261/122.2; 261/DIG. 70

(58) Field of Classification Search ..... 261/122.1, 261/122.2, 124, DIG. 70
See application file for complete search history.

(56) References Cited

U.S. PATENT DOCUMENTS 1,792,285 A * 2/1931 Curry et al. ..... 261/122.2
3,063,689 A * 11/1962 Coppock ..... 239/602
3,642,260 A * 2/1972 Danjes et al. ..... 261/122.1
4,631,134 A 12/1986 Schussler
4,734,191 A * 3/1988 Schussler ..... 210/220
4,842,779 A 6/1989 Jager
4,849,139 A 7/1989 Jager
4,929,397 A * 5/1990 Jager ..... 261/65
5,330,688 A 7/1994 Downs
5,480,593 A * 1/1996 Marcum et al. ..... 261/77
5,693,265 A 12/1997 Jager
5,858,283 A 1/1999 Burris
6,145,817 A * 11/2000 Jager et al. ..... 261/122.2
6,260,831 B1 * 7/2001 Jager ..... 261/122.1
7,044,453 B2 * 5/2006 Tharp ..... 261/122.1

FOREIGN PATENT DOCUMENTS

DE 35 08 593 A1 * 9/1986

OTHER PUBLICATIONS

Circular Membrane with Circumferential Slitting Pattern—Illustrated in the attached photo labeled "Membrane A" and described in the attachment entitled "Statements of Relevance", admitted prior art.

(Continued)

*Primary Examiner*—Scott Bushey

(57) ABSTRACT

A diffuser assembly for diffusing a fluid from a fluid source into a medium to aerate the medium. The diffuser assembly including a diffuser body in fluid communication with the fluid source and a membrane connected to the diffuser body. The membrane is circular and includes a slitting pattern divided into a series of similar angular segments. The segments are positioned adjacent each other in a circular arrangement to substantially cover the membrane. Each segment includes a plurality of rows each having a plurality of slits. The slits within the segment are arranged in a parallelogram pattern. A first line extending between adjacent slits in a common row is substantially the same length as a second line extending between adjacent slits in adjacent rows.

16 Claims, 4 Drawing Sheets

OTHER PUBLICATIONS

Circular Membrane with Segmented Square or Rectangular Slitting Pattern—Illustrated in the attached photo labeled "Membrane B" and described in the attachment entitled "Statements of Relevance", admitted prior art.

Rectangular Membrane with Diamond Puncturing Pattern—Illustrated in the attached photo labeled "Membrane C" and described in the attachment entitled "Statements of Relevance", admitted prior art.

Sanitaire Circular Membrane with Segmented Parallelogram Slitting Pattern—Illustrated in the attached drawings 99-106, 99-106 (Enlarged), and 99-106 (Annotated) and described in the attachment entitled "Statements of Relevance", admitted prior art.

Circular Membrane with Spiral Slitting Pattern—Described in the attachment entitled "Statements of Relevance", admitted prior art.

Circular Membrane with Random Puncturing Pattern—Described in the attachment entitled "Statements of Relevance", admitted prior art.

Rectangular Membrane with Square or Rectangular Slitting Pattern—Described in the attachment entitled "Statements of Relevance", admitted prior art.

* cited by examiner

AERATION DIFFUSER MEMBRANE SLITTING PATTERN

CROSS-REFERENCE TO RELATED APPLICATIONS

This Application claims priority to U.S. Provisional Patent Application No. 60/547,370, filed Feb. 24, 2004. The entire contents of the Provisional Application is hereby incorporated by reference herein.

BACKGROUND

The present invention relates to aeration diffusers used in wastewater treatment tanks, and more specifically to the piercing pattern on the elastomeric membranes of the diffuser assemblies.

Aeration systems are used in wastewater treatment tanks to introduce oxygen into the wastewater. The wastewater is typically contained in treatment tanks, and air is forced through diffuser assemblies to produce fine bubbles that flow through the wastewater. Diffusing a high volume of air or oxygen into the wastewater in the form of fine bubbles facilitates biological growth during the waste treatment process. Supplying air into the treatment tank also serves to prevent sedimentation of the wastewater within the treatment tank. The treatment tank usually includes a network of air distribution piping for transferring air to the diffuser assemblies. The network of air distribution piping typically includes a drop pipe extending from an air supply to a manifold that is submerged within the wastewater. The submerged manifold is connected to a plurality of submerged distribution pipes that are also submerged within the wastewater and generally arranged in a parallel configuration along the bottom of the treatment tank when such tank is of rectangular design. Each distribution pipe typically supports a number of diffuser assemblies such that the diffuser assemblies are also submerged within the wastewater along the bottom of the tank.

Each diffuser assembly includes a diffuser body and includes a membrane coupled to the diffuser body. The membrane includes a perforation pattern that generates the fine bubbles. Diffuser assemblies can include circular or rectangular diffuser bodies and include corresponding circular or rectangular membranes. Many different types of membranes are known and are described in detail below.

The perforation pattern of circular membranes can be either segmented or unsegmented. Segmented patterns divide the surface area of the circular membrane into a number of equal-sized, pie-shaped segments. Each of the segments includes the same or substantially the same piercing pattern. Segmentation allows consistent spacing between and across rows regardless of the radial distance from the center of the membrane. Some known segmented patterns include square or rectangular piercing patterns while others include parallelogram piercing patterns. As shown in FIG. 1, the square or rectangular piercing pattern is generated by creating slits in a square or rectangular pattern across the segment. The parallelogram piercing pattern is generated by creating punctures in a parallelogram pattern across the segment. Slitting is different from puncturing in that a slit is an extended cut into the membrane and a puncture is a generally circular hole through the membrane. Some square or rectangular patterns use curved slits and orient the curved slits in opposite facing directions in adjacent rows.

With further reference to FIG. 1*a*, the line b extending between midpoints of adjacent slits in a common row is the same length as the line a extending between midpoints of adjacent slits of adjacent rows. Specifically, the lines a, b extend between common points (e.g., center points) of the slits. Also, the angle A defined between the lines a, b equals 90 degrees. The common length and 90 degree angle define the square pattern. A rectangular pattern is defined when the 90 degree angle exists, but the lines a, b are not equal. In one embodiment, the perpendicular distance d between adjacent rows is 0.100 inches and the lines a, b are also 0.100 inches. This allows for a maximum bubble diameter D of up to 0.100 inches, at which diameter adjacent bubbles touch and likely coalesce into a single larger bubble which transfers oxygen less effectively than two smaller uncoalesced bubbles.

On round membrane diffusers, unsegmented patterns do not divide the piercing pattern into repeatable angular segments. Known types of unsegmented patterns include a circumferential slitting pattern, a spiral slitting pattern, and a random puncturing pattern. The circumferential slitting pattern includes rows of slits spaced at radial intervals across the surface area of the circular membrane. The relative spacing between adjacent slits is not consistent and varies depending upon the location of the slit on the membrane. The spiral slitting pattern is similar except that it includes a single row of slits that gradually increases its radial position around the circular membrane such that the row wraps or spirals around itself. The random puncturing pattern does not include any repeatable pattern and therefore there is no consistent spacing in any direction between adjacent punctures. To accommodate a maximum bubble size of 0.100 inches before coalescence, such random patterns must accommodate the closest adjacent slits, and are forced to use a row-to-row spacing of 0.100 inches. This pattern is inefficient in the sense that over most of the membrane the center-to-center distance between adjacent slits is greater than 0.100 inches.

Rectangular membranes are generally unsegmented and include a piercing pattern that is continuous across the surface area of the membrane. Some examples of piercing patterns for rectangular membranes include diamond, parallelogram, square or rectangular slitting patterns. With reference to FIG. 1A, a diamond pattern is defined when the base angle A is 60 degrees and the lines a, b are the same distance. In contrast, a parallelogram has a base angle greater than or less than 60 degrees and lines a, b are not equal distances.

SUMMARY

In one embodiment, the invention provides a diffuser assembly for diffusing a fluid from a fluid source into a medium to aerate the medium. The diffuser assembly includes a diffuser body in fluid communication with the fluid source and a membrane connected to the diffuser body. The membrane is circular and includes a slitting pattern divided into a series of similar angular segments. The segments are positioned adjacent each other in a circular arrangement to substantially cover the membrane. Each segment includes a plurality of rows each having a plurality of slits. The slits within the segment are arranged in a parallelogram pattern. A first line extending between the midpoints of adjacent slits in a common row is substantially the same length as a second line extending between the midpoints of adjacent slits in adjacent rows.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
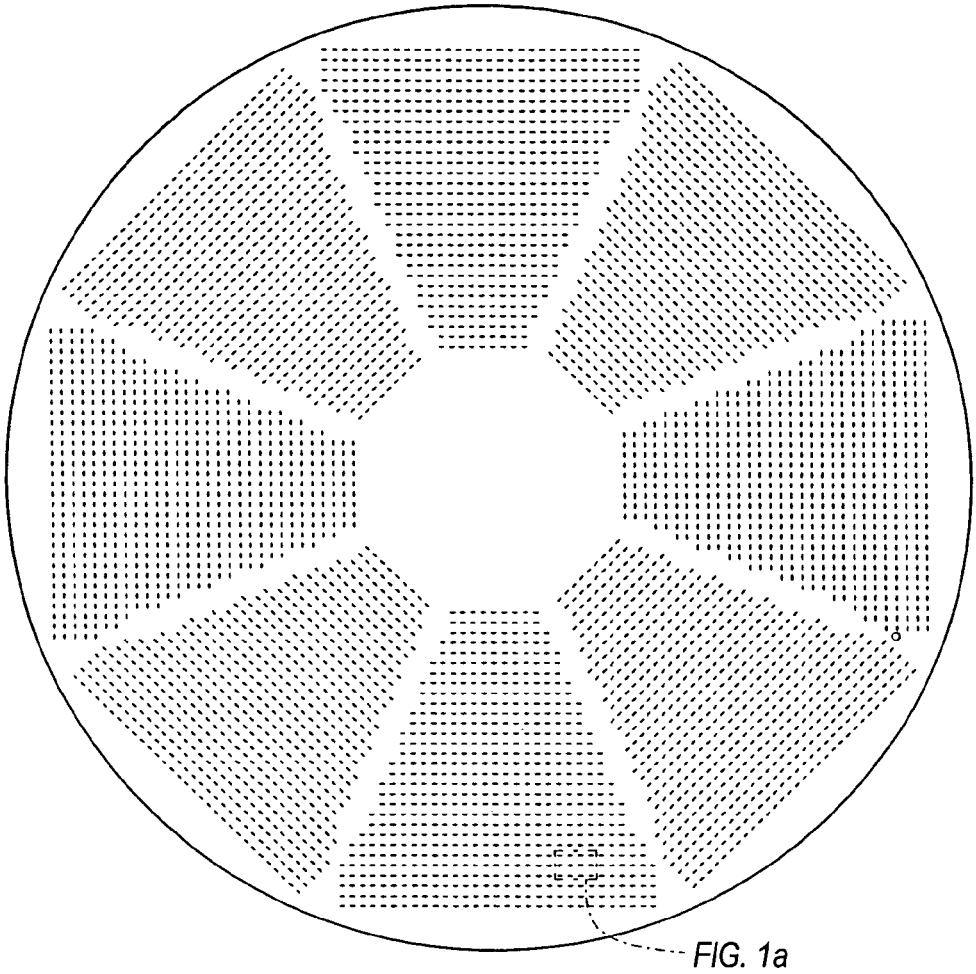
FIG. 1 PRIOR ART
FIG. 1 is a plan view of a circular membrane of the prior art with a segmented square pattern.
Figure 1A:
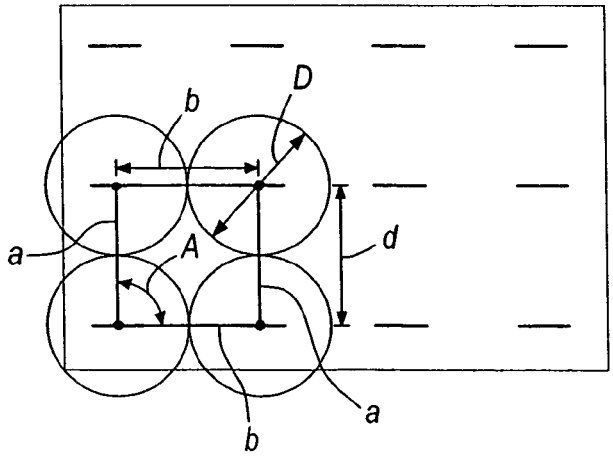
FIG. 1a PRIOR ART
FIG. 1*a* is an enlarged view of the square pattern of the membrane of FIG. 1.
Figure 2:
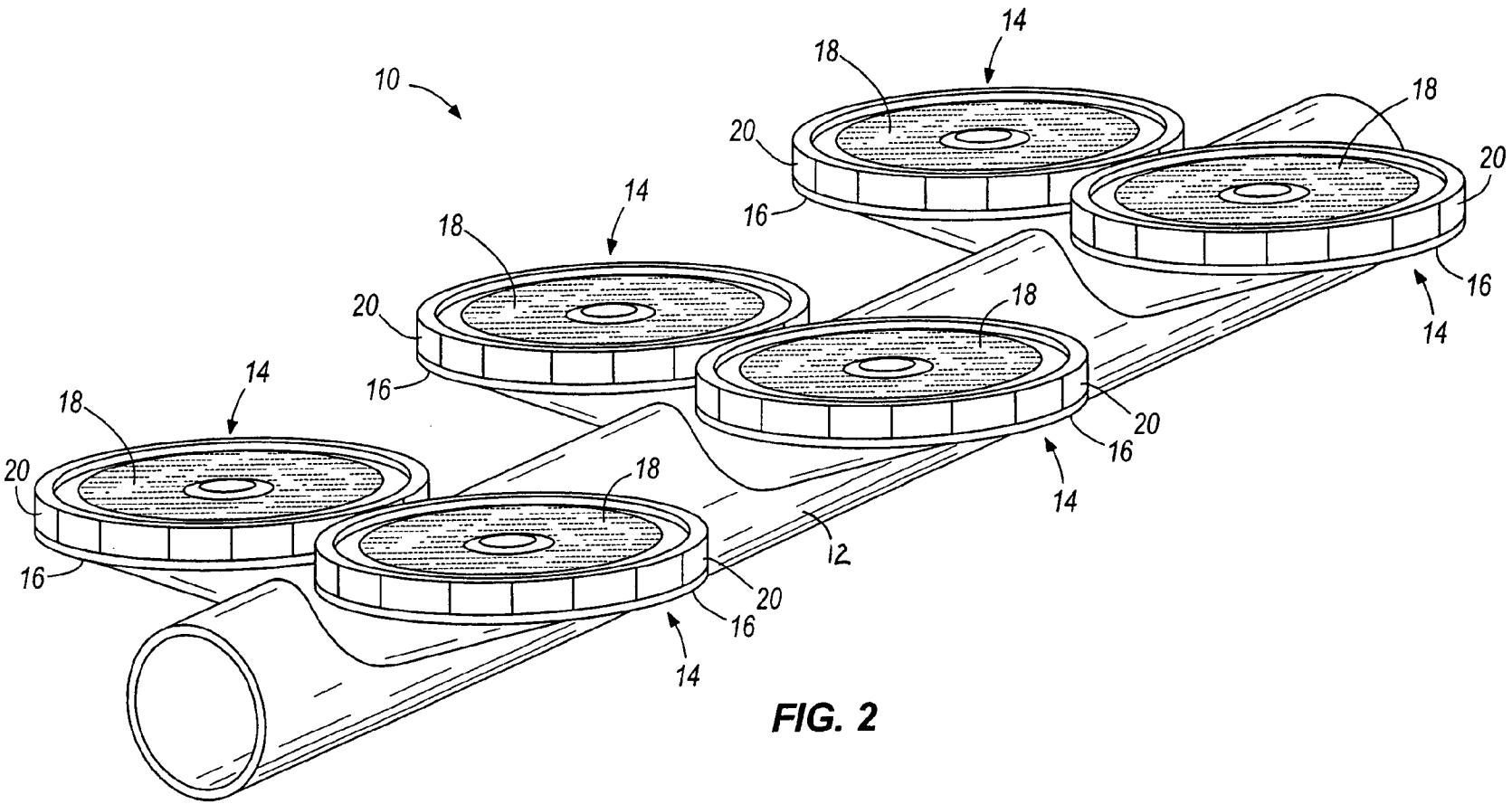
FIG. 2 is perspective view of a portion of an aeration system including a diffuser assembly according to one embodiment of the present invention.

FIG. 2 illustrates a portion of an aeration system 10 of the type commonly used in wastewater treatment tanks to introduce oxygen into wastewater contained in the treatment tanks. The treatment tank usually includes a network of air distribution piping for transferring air to the aeration system 10. The aeration system 10 includes distribution pipes 12 that are generally arranged in a parallel configuration along the bottom of the treatment tank. The distribution pipes 12 are fluidly coupled to a fluid source through, for example, a drop pipe and a manifold.

Each distribution pipe 12 typically supports a number of diffuser assemblies 14 such that the diffuser assemblies 14 are also submerged within the wastewater along the bottom of the tank. A fluid, typically air, is forced through the diffuser assemblies 14 to produce fine bubbles that flow through the wastewater. Diffusing a high volume of air or oxygen into the wastewater in the form of fine bubbles facilitates biological growth during the waste treatment process. Supplying air into the treatment tank also serves to prevent sedimentation of the wastewater within the treatment tank.

Each diffuser assembly 14 includes a diffuser body 16, a diffuser membrane 18, and a diffuser ring 20. The diffuser body 16 is fluidly connected to the distribution pipe 12. The diffuser body 16 is a generally hollow body with one end fluidly connected to the distribution pipe 12 and the other end having an enlarged circular opening. The diffuser membrane 18 covers the opening and the diffuser ring 20 is coupled to the diffuser body 16 to secure the diffuser membrane 18 to the diffuser body 16. The diffuser ring 20 can include internal threads that mate with external threads on the diffuser body 16 around the opening.

Figure 3:
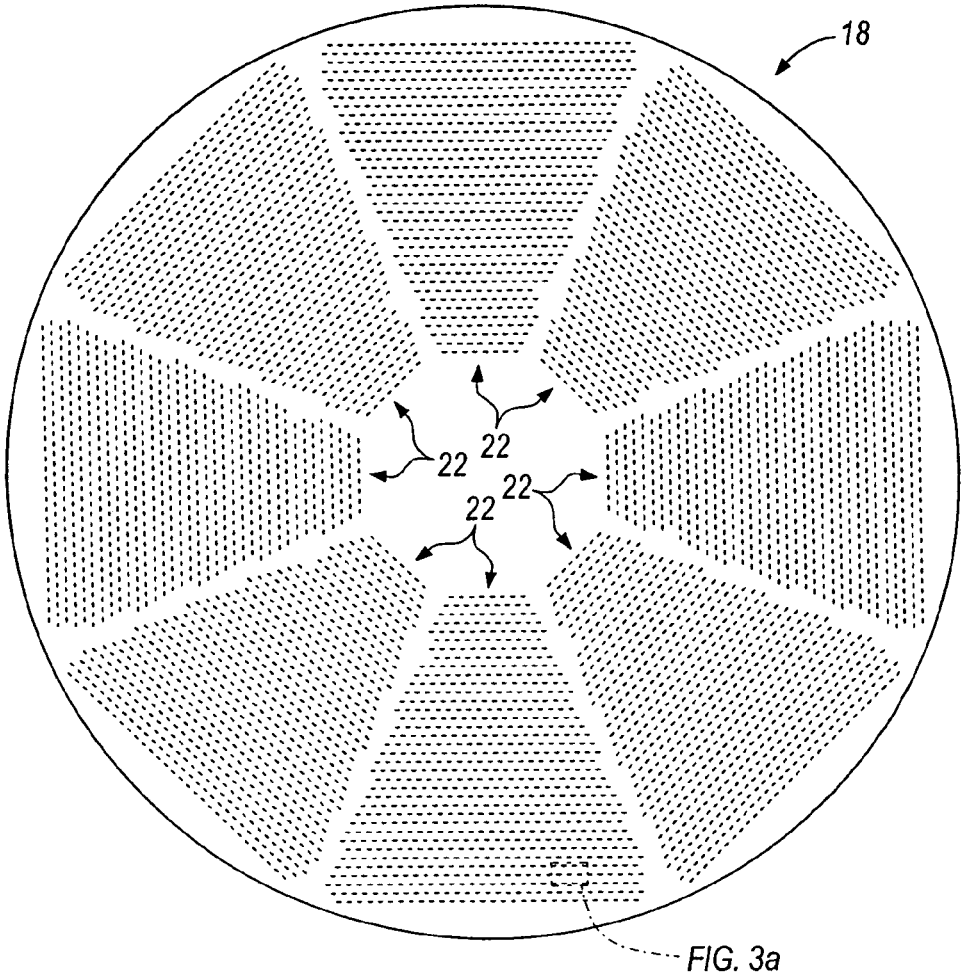
FIG. 3 is a plan view of a circular membrane of the diffuser assembly shown in FIG. 2.
Figure 3A:
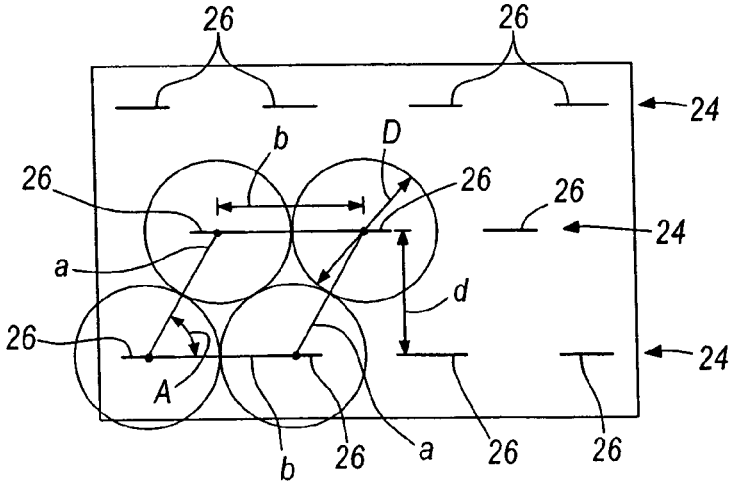
FIG. 3*a* is an enlarged view of a segmented parallelogram pattern of the membrane shown in FIG. 3.

As shown in FIGS. 3 and 3*a*, the membrane 18 includes an optimized perforation pattern that generates the fine bubbles. The membrane 18 is circular and includes a slitting pattern divided into a series of similar angular segments 22. The segments 22 are positioned adjacent each other in a circular arrangement to substantially cover the membrane 18. Each segment 22 includes a plurality of rows 24 each having a plurality of slits 26. The distance d between rows 24 is consistent across the segment 22, however this consistency is not required. The slits 26 within the segment 22 are arranged in a parallelogram pattern. A first line b extending between adjacent slits 26 in a common row 24 is substantially the same length as a second line a extending between adjacent slits 26 in adjacent rows 24.

With specific reference to FIG. 3*a*, the line b extending between midpoints of adjacent slits 26 in a common row 24 is approximately the same length as the line a extending between midpoints of adjacent slits 26 of adjacent rows 24. In other embodiments, the length of line b can be between 80 percent and 120 percent of the line a. The lines a, b define an acute interior angle A that is approximately 60 degrees. In other embodiments, angle A can be between 40 and 80 degrees or can be less than 75 degrees. The common length and the 60 degree angle define the diamond pattern. In contrast, a parallelogram pattern can also be used when the angle is less than 90 and the lines a, b are not equal. In order to avoid coalescence of the fine bubbles, a bubble diameter D of 0.100 inches is suggested. Due to the suggested size of the diameter D, the lines a, b are 0.100 inches and the perpendicular distance d between adjacent rows 24 is reduced to 0.086 inches.

The present invention can reduce the headloss at any given flow of a diffuser assembly 14 while maintaining a good Standard Oxygen Transfer Efficiency (SOTE). In general, smaller bubbles give higher SOTE. The new pattern allows more slits in a given area without increasing the risk of bubble coalescence due to bubble boundaries touching, which could reduce SOTE.

As an example, a diffuser assembly using a circular membrane with a spiral pattern has a headloss of about 12 inches of water column when perforated with a square pattern of slits having a tooth pitch of 0.100" and a row-to-row spacing of 0.100", and an SOTE of approximately 2.2% per foot of diffuser submergence. Changing the slit pattern to a parallelogram (or diamond) which is the subject of this disclosure, using the same EPDM material, increases the slit count by 14 to 20%, lowering the headloss to about 10 inches of water at the same flow. The SOTE performance of the new perforation pattern is approximately equal to the diffuser assembly with the spiral pattern.

The proposed slit pattern is based on a regular repeated pattern of equilateral triangles. In other embodiments, the pattern can be any regular pattern which is not based on a rectangle, such as a diamond shape (parallelogram), or, generally, any departure from a 90 degree angle in a regular pattern. In addition, perforation blades can be mounted in a spiral or concentric circle pattern, and arranged to form the equivalent of a regular pattern "triangles" or "parallelograms".

The diffuser membrane 18 of the present invention can use a regular piercing pattern consisting of a "diamond" shape (or parallelogram) having one 60 degree base angle A (the other base angle being 120 degrees). For a given maximum bubble size, this pattern maximizes the bubbles per square inch.

Figure 4:
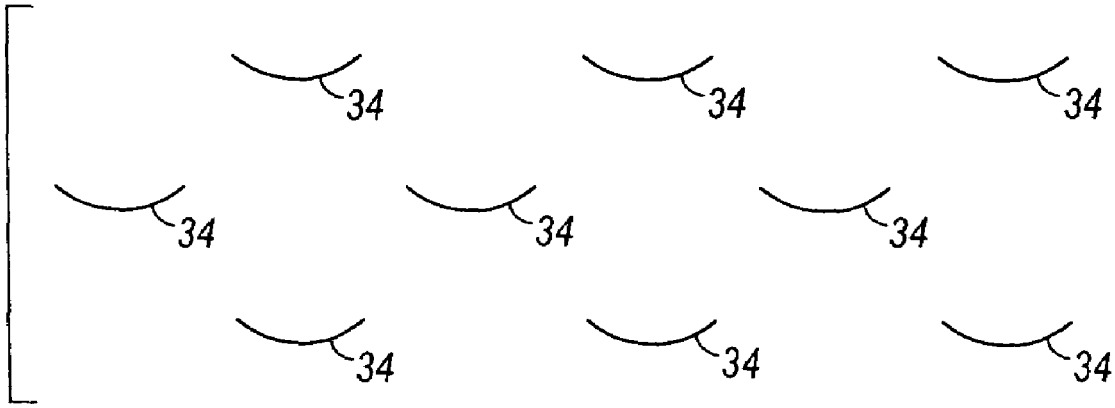
FIG. 4 is a plan view of a slitting pattern of a circular membrane according to another embodiment of the invention.

Use of a parallelogram with one base angle which is larger than 60 degrees but smaller than 90 degrees, or a parallelogram with one base angle less than 60 degrees, will result in the potential for more perforations per square inch than for a pattern with a base angle of 90 degrees, but fewer than for a pattern using 60 degrees. In general, the use of any angle less than 90 degrees (within limits of practicality) results in an improvement in perforations per unit area without a sacrifice in bubble size and SOTE As shown in FIG. 4, curved slits 34 can also be used to define the slitting pattern. The curved slits 34 within each segment are oriented in the same direction.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention.

What is claimed is:

1. A diffuser assembly for diffusing a fluid from a fluid source into a medium to aerate the medium, the diffuser assembly comprising:

a diffuser body in fluid communication with the fluid source; and a membrane connected to the diffuser body, the membrane being circular and including a slitting pattern divided into a series of similar angular segments positioned adjacent each other in a circular arrangement to substantially cover the membrane, each segment including a plurality of rows each having a plurality of slits, midpoints of the slits within the segment arranged in a parallelogram pattern, wherein a first line extending between the midpoints of adjacent slits in a common row is substantially the same length as a second line extending between the midpoints of adjacent slits in adjacent rows.

2. The diffuser assembly of claim 1, wherein the length of the first line is equal to the length of the second line.

3. The diffuser assembly of claim 2, wherein the length of the lines equals about 0.100 inches.

4. The diffuser assembly of claim 1, wherein the first line and the second line define an included relative acute angle.

5. The diffuser assembly of claim 4, wherein the angle is between 40 and 80 degrees.

6. The diffuser assembly of claim 4, wherein the angle is less than 75 degrees.

7. The diffuser assembly of claim 4, wherein the angle is 60 degrees.

8. The diffuser assembly of claim 7, wherein the length of the first line is equal to the length of the second line.

9. The diffuser assembly of claim 8, wherein adjacent rows of the plurality of rows are separated by a distance, the distance between adjacent rows being consistent across the segment.

10. The diffuser assembly of claim 9, wherein the distance equals 86% of the length of the line between the midpoints of adjacent slits.

11. The diffuser assembly of claim 9, wherein each row is straight and wherein the rows are parallel to each other.

12. The diffuser assembly of claim 1, wherein adjacent slits within a row of the plurality of rows are separated by a distance, the distance between adjacent slits being consistent across the row.

13. The diffuser assembly of claim 1, wherein the slits are curved.

14. The diffuser assembly of claim 13, wherein the slits within each segment are oriented in the same direction.

15. The diffuser assembly of claim 1, wherein the series of angular segments includes 8 equally sized segments.

16. The diffuser assembly of claim 1, wherein each slit includes a slit length, wherein all slits lengths are substantially equal.

* * * * *